United States Patent [19]

Nishihama et al.

[11] Patent Number: 4,861,442

[45] Date of Patent: Aug. 29, 1989

[54] ZINC-NICKEL ALLOY PLATING BATH AND PLATING METHOD

[75] Inventor: Yukio Nishihama; Yasutaka Kubota, both of Hirakata; Noriko tanaka, Osaka, all of Japan

[73] Assignee: Okuno Chemical Industries Co., Ltd., Japan

[21] Appl. No.: 313,124

[22] Filed: Feb. 21, 1989

[30] Foreign Application Priority Data

Feb. 26, 1988 [JP] Japan ..... 63-45343

[51] Int. Cl.[4] ..... C25D 3/56

[52] U.S. Cl. ..... 204/44.2

[58] Field of Search ..... 204/44.2, 44.5

[56] References Cited

U.S. PATENT DOCUMENTS 4,388,160 6/1983 Rynne ..... 204/44.2 X
4,765,871 8/1988 Hsu et al. ..... 204/44.2

FOREIGN PATENT DOCUMENTS 240788 10/1987 Japan .
287092 12/1987 Japan .
53285 7/1988 Japan .
524866 8/1976 U.S.S.R. .

*Primary Examiner*—G. L. Kaplan
*Attorney, Agent, or Firm*—Timothy R. Kroboth

[57] ABSTRACT

The invention provides a zinc-nickel alloy plating bath comprising about 3 to about 30 g/l of Zn ion, about 0.2 to about 20 g/l of Ni ion, about 20 to about 300 g/l of alkali hydroxide, about 0.05 to about 10 g/l of amino-alcohol polymer, an Ni-complexing agent in an amount of about 1 to about 20 moles per mole of Ni ion, and about 0.01 to about 20 g/l of amino acid and/or a salt of amino acid, the bath having a pH of 11 or more.

13 Claims, No Drawings

ZINC-NICKEL ALLOY PLATING BATH AND PLATING METHOD

FIELD OF THE INVENTION

The present invention relates to zinc-nickel alloy plating baths and plating methods using the baths.

BACKGROUND OF THE INVENTION

Plating films of zinc-nickel alloy are well known as being more corrosion-resistant than zinc plating films and have been increasingly used in recent years, for example, to improve the corrosion resistance of automotive parts and the like.

Methods heretofore proposed for forming a film of zinc-nickel alloy include, for example, electroplating methods using an acid plating bath comprising zinc chloride and nickel chloride (Japanese Examined Patent Publication No. 12343/1985). However, the proposed method has drawbacks. If the method gives a film of zinc-nickel alloy having a thickness of about 5 μm required for prevention of corrosion, the film exhibits reduced flexibility, posing the following problems. For example, if an automotive part with the 5 μm-thick film formed thereon has been installed in an automotive body, the stress applied during installation causes cracking in the film. In this case, the zinc-nickel alloy film is less corrosion-resistant than a zinc film because of this defect as well as due to its lesser degree of sacrificial anticorrosive action on an iron substrate than the zinc film. On the other hand, if the zinc-nickel alloy film has a thickness of less than 5 μm, no cracking would occur during installation but the film is not fully satisfactory in corrosion resistance. Further a film of locally irregular thickness is formed by the method because electroplating unavoidably entails an uneven current density at the surface of substrate to be electroplated. For example, the film is imparted an unnecessarily large thickness over a substrate portion of higher current density where cracking is more likely to develop in installation. More disadvantageously said acid plating bath contains a large amount of chloride which tends to cause corrosion in the plating equipment due to their marked corrosive property.

SUMMARY OF THE INVENTION

It is an object of the present invention to provide a zinc-nickel alloy plating bath capable of forming a zinc-nickel alloy film having excellent gloss, high corrosion resistance and good flexibility, and a plating method using the bath.

It is another object of the invention to provide a zinc-nickel alloy plating bath capable of forming a zinc-nickel alloy film having a substantially uniform thickness, irrespective of current density distribution on the surface of a substrate to be plated, and a plating method using the bath.

It is a further object of the invention to provide a zinc-nickel alloy plating bath which is unlikely to cause corrosion in the plating equipment, and a plating method using the bath.

It is a still further object of the invention to provide a zinc-nickel alloy plating bath capable of forming a zinc-nickel alloy film containing zinc and nickel in a virtually constant ratio, and a plating method using the bath.

Other objects and features of the invention will become apparent from the following description.

DETAILED DESCRIPTION OF THE INVENTION

The present invention provides a zinc-nickel alloy plating bath comprising about 3 to about 30 g/l of Zn ion, about 0.2 to about 20 g/l of Ni ion, about 20 to about 300 g/l of alkali hydroxide, about 0.05 to about 10 g/l of amino-alcohol polymer, an Ni-complexing agent in an amount of about 1 to about 20 moles per mole of Ni ion, and about 0.01 to about 20 g/l of amino acid and/or a salt of amino acid, the bath having a pH of 11 or more.

According to the present invention, a zinc-nickel alloy film having proper gloss, good corrosion resistance and high flexibility is produced by using a zinc-nickel alloy plating bath comprising the above-specified amounts of above-specified components. If a part with a 5 μm or more-thick zinc-nickel alloy film formed thereon according to the invention is installed, for example, in an automotive body, the film will not crack on exertion of stress in installation and will sustain high corrosion resistance after installation. When the surface of a substrate to be electroplated is provided with irregular current density on electroplating, the current efficiency is automatically adjusted, for example, at a local surface portion of high current density in accordance with the invention, so that the film is afforded a uniform thickness. With this advantage, the plating bath of the invention is suitable for plating a substrate of complex shape which potentially involves a wide distribution of current density. The plating bath of the invention is unlikely to corrode the plating equipment and thus can save the costs for protecting the plating equipment against corrosion. Moreover, according to the invention, the zinc-nickel alloy film thus formed contains zinc and nickel in a substantially constant ratio.

Examples of the source of Zn ions which can be used in the invention include zinc oxide, zinc hydroxide, inorganic acid salts of zinc, organic acid salts of zinc, etc. Preferable examples are zinc oxide, zinc hydroxide, zinc sulfate, zinc carbonate, ammonium zinc sulfate, zinc acetate, zinc sulfamate, zinc bromide, zinc tartrate, etc. They are usable singly or at least two of them can be used in mixture. The amount of the Zn ion source used is about 3 to about 30 g/l, preferably about 6 to about 15 g/l, calculated as Zn ion. Use of less than about 3 g/l of Zn ion source lowers the current efficiency during plating, making it difficult to produce a film of sufficient thickness, hence disadvantageous in terms of operational efficiency. On the other hand, use of more than about 30 g/l of Zn ion source brings about a substantial difference in current efficiency between local portions of high current density and low current density, making it difficult to obtain a film of uniform thickness.

Examples of the source of Ni ions which can be used in the invention include hydroxides of nickel, inorganic acid salts of nickel, organic acid salts of nickel, etc. Preferable examples are nickel hydroxide, nickel sulfate, nickel carbonate, ammonium nickel sulfate, nickel sulfamate, nickel acetate, nickel formate, nickel bromide, etc. They are usable singly or at least two of them can be used in mixture. The amount of the Ni ion source used is about 0.2 to about 20 g/l, preferably about 0.4 to about 8 g/l, calculated as Ni ion. If the Ni ion content is less than about 0.2 g/l, the zinc-nickel ratio in the film is varied depending on a slight change of nickel concentration in the plating bath, leading to difficulties in giving a film with a practically constant zinc-nickel ratio and thus in controlling the concentration of other components in the bath. On the other hand, the Ni ion content of more than about 20 g/l is uneconomical because the consumption of bath leads to marked loss of expensive nickel.

Useful alkali hydroxides include known ones such as sodium hydroxide, potassium hydroxide, etc. These alkali hydroxides are usable singly or at least two of them can be used in mixture. The amount of the alkali hydroxide used is about 20 to about 300 g/l, preferably about 60 to about 150 g/l. The alkali hydroxide content of less than about 20 g/l provides a plating bath with a pH of less than 11, posing the following problems. If the bath has a pH of less than 11, the zinc compound serving as a source of Zn ion is made unstable so that the concentration of Zn ion in the plating bath can not be held at the specific range. In this case, the plating bath is rendered less electroconductive and requires a higher voltage in obtaining the desired electric current than in usual operation, leading to waste of power. If the alkali hydroxide content exceeds about 300 g/l, the film is likely to turn from white gloss to gray semi-gloss or blackish gray, dull state, making it difficult to provide a good appearance.

Useful Ni-complexing agents include known ones such as citric acid, artaric acid, heptonic acid, gluconic acid, malic acid, glycollic acid, lactic acid, hydroacrylic acid, α-hydroxybutyric acid, β-hydroxybutyric acid, tartronic acid, salicylic acid, sulfosalicylic acid and like oxycarboxylic acids, or sodium salts or potassium salts thereof, ethylenediamine, diethylenetriamine, triethylenetetramine, N-(2-aminoethyl)ethanolamine, 2-hydroxyethylaminopropylamine, N,N-dimethyl-1,3-diaminopropane, 1-amino-4-methylpiperazine, N-methylethylenediamine, N-ethylethylenediamine, N-n-propylethylenediamine, N-isopropylethylenediamine, N-(2-hydroxyethyl)ethylenediamine, N,N-dimethylethylenediamine, N,N'-dimethylethylenediamine, N,N'-diethylethylenediamine, N,N'-di-n-propylethylenediamine, N,N'-di(2-hydroxyethyl)ethylenediamine, N,N,N',N'-tetramethylethylenediamine, 1,2-diaminopropane, 1,3-diaminopropane, trimethylenediamine, N-(2-hydroxyethyl)-1,3-diaminopropane, 1,2-diaminocyclohexane, 1,2,3-triaminopropane, 1,3-diamino-2-aminomethylpropane, 3,3'-diaminopropylamine, 2,2',2''-triaminotriethylamine, di(2-aminoethyl)ether, 1-amino-4-methylpiperazine, pyridine-2-carboxylic acid, pyridine2,3-dicarboxylic acid, pyridine-2,4-dicarboxylic acid, pyridine-2,6-dicarboxylic acid, nicotinic acid hydrazide, isonicotinic acid hydrazide, pyridoxamine, histamine and like amino compounds, etc. These complexing agents are usable singly or at least two of them can be used in mixture. The amount of the Ni-complexing agent used is about 1 to about 20 moles, preferably about 1 to about 5 moles, per mole of the Ni ion. Less than 1 mole of the Ni-complexing agent used lowers the solubility of nickel in the plating bath, making it impossible to retain the concentration of nickel required for alloy plating. More than about 20 moles of Ni-complexing agent used significantly reduces the nickel content in the film, making it difficult to provide a film of satisfactory corrosion resistance.

Useful amino-alcohol polymers include those heretofore known such as copolymers comprising at least one amino compound and at least one compound selected from the group consisting of epihalohydrin and glycerol halohydrin (polymerization degree of about 10 to about 10000, preferably about 500 to about 2000), etc. The copolymerization can be conducted by conventional methods disclosed in, e.g. Japanese Examined Patent Publication No. 825/1975, Japanese Unexamined Patent Publication No. 87934/1975, Japanese Examined Patent Publication No. 30394/1983, Japanese Unexamined Patent Publication No. 199889/1983, Metallic Surface Technology Association: Summary of Lectures in 50th Scientific Lecture Meeting, pages 12 and 13 (1974), etc. Stated more specifically, the copolymerization is performed, for example, by dissolving about 0.1 to about 10 parts by weight of an amino compound in about 0.05 to about 20 parts by weight of water and adding dropwise epihalohydrin and/or glycerol halohydrin to the solution at a suitable temperature in the range of about 20° to about 100° C. There is no specific limitation on the amounts of amino compound and epihalohydrin and/or glycerol halohydrin used. Usually about 0.9 to about 2 moles of epihalohydrin and/or glycerol halohydrin is used per mole of amino compound. Examples of useful amino compounds are primary amines, secondary amines, tertiary amines, aromatic amines, alicyclic amines, cyclic amines, amino-alcohols, etc. Specific examples are dimethylamine, N,N,N',N'-tetramethyl,-1,3-diaminopropane, N,N-dimethyl-1,3-diaminopropane, N,N,N',N'-tetramethyl-1,4-diaminobutane, imidazole, 2-methylimidazole, 2-aminopyridine, 3-aminopyridine, 4-aminopyridine, piperazine, 1-aminoethylpiperazine, N-aminopropylmorpholine, N-aminoethylpiperidine, 2-aminoethanol, diethanolamine, monomethylamine, 1-aminopropane, 1,2-diaminopropane, 1,3-diaminopropane, diethylenetriamine, triethylenetetramine, tetraethylenepentamine, pentaethylenehexamine, N,N-dimethyl-1,3-diaminoethane, N,N-diethyl-1,3-diaminoethane, N,N-dimethyl-1,2-diaminopropane, N,N-diethyl-1,3-diaminopropane, hexamethylenetetramine, 2-amino-4-methylpyridine, 2-amino-5-methylpyridine, 2-amino-4-ethylpyridine, 2-amino-4-propylpyridine, 2-picolyamine, 3-picolylamine, 4-picolylamine, 4-methylimidazole, 2-ethyl-4-methylimidazole, 1-aminoethyl-2-methylimidazole, 4-methyl-5-hydroxymethylimidazole, 2-aminoethylpiperazine, N-aminopiperidine, 2-aminomethylpiperidine, 4-aminomethylpiperidine, N-amino-4-pipecoline, N-aminoethylmorpholine, N-(2-hydroxyethyl)ethylenediamine, N,N-di(2-hydroxyethyl)ethylenediamine, N-(2-hydroxyethyl)-1,3-diaminopropane, N-(2-aminoethyl)ethanolamine, etc. Examples of the epihalohydrin are epichlorohydrin, epibromohydrin, epiiodohydrin, etc. Examples of the glycerol halohydrin are 1,2-dichloro-3-propanol, 1,3-diiodo-2-propanol, 1,3-dibromo-2-propanol, 1,3-dichloro-2-propanol, etc.

Amino-alcohol copolymers are usable singly or at least two of them can be used in mixture. The amount of the amino-alcohol copolymer used is about 0.05 to about 10 g/l, preferably about 0.6 to about 3 g/l. The aminoalcohol copolymer content of less than about 0.05 g/l provides a film with a rough surface of semi-gloss, whereas its content of over about 10 g/l provides a film with impaired adhesion between the film and the substrate.

Useful amino acids include known ones such as neutral amino acids, e.g. alanine, serine, aminobutyric acid, threonine, valine, norvaline, leucine, isoleucine, citrulline, phenylalanine, tyrosine, diiodotyrosine, dioxyphenylalanine, dibromotyrosine, proline, oxyproline, tryptophan, cysteine, cystine, methionine and the like; acidic amino acids, e.g. aspartic acid, glutamic acid and the like; and basic amino acids, e.g. arginine, lysine, oxylysine, orthinine, canavanine, histidine and the like. Examples of the amino acid salt useful in the invention are sodium salts or potassium salts of the above-exemplified amino acids, etc. These amino acids and amino acid salts are usable singly or at least two of them can be used in mixture. The amount of the amino acid and/or amino acid salt used is about 0.01 to about 20 g/l, preferably about 0.03 to about 10 g/l. Their content of less than about 0.01 g/l provides a film unsatisfactory in gloss, corrosion resistance, flexibility and the like, whereas their content of more than about 20 g/l poses no particular problem but without any better result, hence economically futile.

The plating bath of the present invention may further contain an aldehyde to achieve further improvements in gloss, leveling and the like. Examples of aldehydes are aromatic aldehydes such as anisaldehyde, 4-hydroxy-3-methoxybenzaldehyde (vanillin), 1,3-benzodioxole-5-carboxaldehyde(piperonal), veratraldehyde, p-tolualdehyde, benzaldehyde, o-chlorobenzaldehyde, 2,3-dimethoxybenzaldehyde, o-ethoxybenzaldehyde, salicylaldehyde, cinnamaldehyde, an adduct of such aldehyde with sodium sulfite, etc. The amount of the aldehyde used is not particularly limited and is usually about 0.01 to about 2 g/l, preferably about 0.05 to about 0.5 g/l.

The plating bath of the invention can be prepared by conventional methods, for example, by adding the specific amounts of said components to water. The thus obtained plating bath of the invention is given a pH of 11 or more due to the specific amount of alkali hydroxide contained therein.

Electroplating using the plating bath of the invention can be carried out by known electroplating methods. The electroplating conditions in the invention are not critical and suitably determined. Usually the plating temperature is about 15° to about 45° C., preferably about 20° to about 30° C. The average electric density is about 0.5 to about 10 A/dm$^2$, preferably about 0.6 to about 3 A/dm$^2$.

The plating bath of the invention can be used over substantially all kinds of substrates on which a zinc-nickel alloy can be deposited. Examples of useful substrates are those of mild steel, spring steel, chrome steel, chrome-molybdenum steel, Cu, a 7:3 Cu-Zn alloy, a 6:4 Cu-Zn alloy, etc.

The present invention will be described below in greater detail with reference to the following Examples and Comparison Examples.

EXAMPLE 1

The following mixture was used as a plating bath.

| | |
|---|---|
| ZnO | 13 g/l |
| $NiSO_4.6H_2O$ | 5.2 g/l |
| NaOH | 140 g/l |
| Diethylenetriamine | 3.8 g/l |
| Amino-alcohol polymer A | 1.2 g/l |
| Tyrosine | 0.72 g/l |

The amino-alcohol polymer A used was a copolymer of 1 mole of N,N,N', N'-tetramethyl-1,3-diaminopropane per 1 mole of epichlorohydrin (average polymerization degree 500).

A mild steel panel measuring 50×50×0.5 mm was electroplated using the plating bath (pH 12.8) having the above composition at a plating temperature of 30° C. and at a current density of 1 A/dm$^2$ for 10 minutes. The thus obtained film had good gloss. In this way, two additional films were produced on mild steel panels of the same type under the same conditions as above with the exception of employing current densities of 4 A/dm$^2$ and 10 A/dm$^2$, respectively. Table 1 below shows the film thickness (μm) and the nickel content (wt %) in the film.

Subsequently three mild steel panels of 0.5 mm in thickness were electroplated under the same conditions as above to give films each having a thickness of 5 μm. Stress was applied to the plated mild steel panels in the following manner. Then the plated mild steel panels were subjected to corrosion-resistance test (salt spray test according to JIS-Z-2371). Stated more specifically, the plated mild steel panels were bent through 90° and returned to the original state after which they were bent again at the same bent portion through 90° in the reverse direction and restored to horizontal level. Thereafter a saline solution was sprayed over the plated faces of the mild steel panels. The time was determined which was taken until red rust occurred on the mild steel panel. Table 1 below shows the results.

TABLE 1

| Current density (A/dm$^2$) | Film thickness (μm) | Nickel content (wt %) | Time for rusting (hr) |
|---|---|---|---|
| 1 | 2.4 | 8.2 | 212 |
| 4 | 6.8 | 7.7 | 234 |
| 10 | 9.9 | 7.7 | 240 |

EXAMPLE 2

Films of good gloss were formed by carrying out the same procedure as in Example 1 with the exception of using monosodium asparate in an amount of 10 g/l in place of tyrosine. Table 2 below shows the film thickness, nickel content in the film and time for rusting.

TABLE 2

| Current density (A/dm$^2$) | Film thickness (μm) | Nickel content (wt %) | Time for rusting (hr) |
|---|---|---|---|
| 1 | 2.5 | 8.2 | 208 |
| 4 | 7.0 | 7.6 | 238 |
| 10 | 9.8 | 7.1 | 254 |

EXAMPLE 3

Films of good gloss were produced by performing the same procedure as in Example 1 with the exception of using 0.03 g/l of oxylysine in place of tyrosine. Table 3 below shows the film thickness, nickel content in the film and time for rusting.

TABLE 3

| Current density (A/dm$^2$) | Film thickness (μm) | Nickel content (wt %) | Time for rusting (hr) |
|---|---|---|---|
| 1 | 2.4 | 8.3 | 216 |
| 4 | 6.8 | 7.8 | 232 |
| 10 | 9.9 | 7.3 | 242 |

EXAMPLE 4

Anisaldehyde (0.03 g/l) was added to a plating bath of the type used in Example 1. Electroplating was conducted in the same manner as done in Example 1, giving films of good specular gloss. Table 4 below shows the film thickness, nickel content in the film and time for rusting.

TABLE 4

| Current density ($A/dm^2$) | Film thickness (μm) | Nickel content (wt %) | Time for rusting (hr) |
|---|---|---|---|
| 1 | 2.5 | 7.9 | 162 |
| 4 | 7.0 | 7.4 | 185 |
| 10 | 10.2 | 7.3 | 210 |

EXAMPLE 5

The following mixture was used as a plating bath.

| | |
|---|---|
| ZnO | 25 g/l |
| $NiSO_4.6H_2O$ | 35.9 g/l |
| NaOH | 180 g/l |
| Potassium hydrogentartrate | 26.3 g/l |
| Ethylenediamine | 21.9 g/l |
| Amino-alcohol polymer B | 0.75 g/l |
| Histidine | 0.02 g/l |
| Glycine | 2.8 g/l |

The amino-alcohol polymer B used was a copolymer obtained by copolymerizing 0.5 mole of 2-methylimidazole and 1.5 moles of N,N,N',N'-tetramethyl-1,3-diaminopropane per 2 moles of 1,3-dichloro-2-propanol (average polymerization degree 230)

Films of good gloss were formed by effecting the same procedure as in Example 1 with the exception of using a plating bath (pH 13.5) of the above composition. Table 5 shows the film thickness, nickel content in the film and time for rusting.

TABLE 5

| Current density ($A/dm^2$) | Film thickness (μm) | Nickel content (wt %) | Time for rusting (hr) |
|---|---|---|---|
| 1 | 2.9 | 10.1 | 212 |
| 4 | 9.7 | 9.2 | 243 |
| 10 | 13.8 | 9.2 | 256 |

COMPARISON EXAMPLE 1

Electroplating was conducted in the same manner as done in Example 1 with the exception of using a plating path having the following composition as disclosed in Japanese Examined Patent Publication No. 12343/1985 and employing a plating temperature of 35° C.

| | |
|---|---|
| $ZnCl_2$ | 100 g/l |
| $NiCl_2.6H_2O$ | 130 g/l |
| $NH_4Cl$ | 200 g/l |
| Polyoxyethylene alkyl ether | 1.5 g/l |
| Benzalacetone | 0.08 g/l |
| (adjusted to a pH of 5.7 with 25% ammonium hydroxide) | |

The same procedure as above was repeated to form films at different current densities. The films thus produced all had high gloss. However, the film thickness and the nickel content in the film were widely varied with the change of current density, and the films exhibited considerably low corrosion resistance. Table 6 below shows the results.

TABLE 6

| Current density ($A/dm^2$) | Film thickness (μm) | Nickel content (wt %) | Time for rusting (hr) |
|---|---|---|---|
| 1 | 3.0 | 14.2 | 36 |
| 4 | 11.0 | 8.7 | 48 |
| 10 | 24.8 | 7.7 | 62 |

COMPARISON EXAMPLE 2

Electroplating was conducted by performing the same procedure as in Example 1 to form the required number of films with the exception of using no tyrosine. The film formed at a current density of 1 $A/dm^2$ was gray and dull. The films obtained at current densities of 4 $A/dm^2$ and 10 $A/dm^2$, respectively displayed only a slight gloss and thus an appearance unsuitable for use. Table 7 below shows the film thickness, nickel content in the film and time for rusting.

TABLE 7

| Current density ($A/dm^2$) | Film thickness (μm) | Nickel content (wt %) | Time for rusting (hr) |
|---|---|---|---|
| 1 | 1.2 | 18.8 | 51 |
| 4 | 4.9 | 9.5 | 69 |
| 10 | 15.2 | 6.3 | 98 |

Tables 1 to 7 show that when the plating bath of the present invention was used, (a) the films obtained were only slightly varied in film thickness and nickel content with the change of current density, and (b) the films exhibited markedly higher corrosion resistance after the application of stress than conventional zinc-nickel alloy films.

We claim:

1. A zinc-nickel alloy plating bath comprising about 3 to about 30 g/l of Zn ion, about 0.2 to about 20 g/l of Ni ion, about 20 to about 300 g/l of alkali hydroxide, about 0.05 to about 10 g/l of amino-alcohol polymer, an Ni-complexing agent in an amount of about 1 to about 20 moles per mole of ni ion, and about 0.01 to about 20 g/l of amino acid and/or a salt of amino acid, the bath having a pH of 11 or more.

2. A zinc-nickel alloy plating bath according to claim 1 which comprises about 6 to about 15 g/l of Zn ion, about 0.4 to about 8 g/l of Ni ion, about 60 to about 150 g/l of alkali hydroxide, about 0.6 to about 3 g/l of amino-alcohol polymer, an Ni-complexing agent in an amount of about 1 to about 5 moles per mole of Ni ion, and about 0.03 to about 10 g/l of amino acid and/or a salt of amino acid, the bath having a pH of 11 or more.

3. A zinc-nickel alloy plating bath according to claim 1 which further comprises an aldehyde.

4. A zinc-nickel alloy plating bath according to claim 1 in which the amino-alcohol polymer is a copolymer comprising at least one amino compound and at least one compound selected from the group consisting of epihalohydrin and glycerol halohydrin.

5. A zinc-nickel alloy plating bath according to claim 1 in which the amino-alcohol polymer has a polymerization degree of about 10 to about 10000.

6. A zinc-nickel alloy plating bath according to claim 5 in which the amino-alcohol polymer has a polymerization degree of about 500 to about 2000.

7. A plating method comprising electroplating at a plating temperature of about 15° to about 45° C. and at an average current density of about 0.5 to about 10

A/dm$^2$ using a zinc-nickel alloy plating bath which has a pH of 11 or more and which comprises about 3 to about 30 g/l of Zn ion, about 0.2 to about 20 g/l of Ni ion, about 20 to about 300 g/l of alkali hydroxide, about 0.05 to about 10 g/l of amino-alcohol polymer, an Ni-complexing agent in an amount of about 1 to about 20 moles per mole of Ni ion, and about 0.01 to about 20 g/ of amino acid and/or a salt of amino acid.

8. A plating method according to claim 7 in which electroplating is conducted at a temperature of about 20° to about 30° C. and at an average current density of about 0.6 to about 3 A/dm$^2$.

9. A plating method according to claim 7 in which the zinc-nickel alloy plating bath has a pH of 11 or more and comprises about 6 to about 15 g/l of Zn ion, about 0.4 to about 8 g/l of Ni ion, about 60 to about 150 g/l of alkali hydroxide, about 0.6 to about 3 g/l of amino-alcohol polymer, an Ni-complexing agent in an amount of about 1 to about 5 moles per mole of Ni ion, and about 0.03 to about 10 g/l of amino acid and/or a salt of amino acid.

10. A plating method according to claim 7 in which the zinc-nickel alloy plating bath further comprises an aldehyde.

11. A plating method according to claim 7 in which the amino-alcohol polymer is a copolymer comprising at least one amino compound and at least one compound selected from the group consisting of epihalohydrin and glycerol halohydrin.

12. A plating method according to claim 7 in which the amino-alcohol polymer has a polymerization degree of about 10 to about 10000.

13. A plating method according to claim 12 in which the amino-alcohol polymer has a polymerization degree of about 500 to about 2000.

* * * * *